United States Patent [19]

Joseph et al.

[11] Patent Number: 4,741,457

[45] Date of Patent: May 3, 1988

[54] TRANSPORT CONTAINER

[75] Inventors: Frank Joseph, Gernsheim; Helmuth Krauss, Bensheim, both of Fed. Rep. of Germany

[73] Assignee: Merck Patent Gesellschaft Mit Beschraenkter Haftung, Darmstadt, Fed. Rep. of Germany

[21] Appl. No.: 106,297

[22] Filed: Oct. 9, 1987

[30] Foreign Application Priority Data

Oct. 30, 1986 [DE] Fed. Rep. of Germany ..... 3636886

[51] Int. Cl.[4] ..... B65D 7/00

[52] U.S. Cl. ..... 220/466; 220/5 R; 220/85 P; 215/1 C

[58] Field of Search ..... 220/466, 465, 462, 461, 220/455, 453, 85 P, 5 R, 5 A, 1 B, 3; 215/1 C

[56] References Cited

U.S. PATENT DOCUMENTS

| | | | |
|---|---|---|---|
| 3,357,594 | 12/1967 | Grosh et al. | 220/5 A |
| 3,952,904 | 4/1976 | Verlinden | 220/5 R |
| 4,573,603 | 3/1986 | Starling et al. | 220/5 R |
| 4,605,126 | 8/1986 | Goedken et al. | 220/1 BX |
| 4,690,295 | 9/1987 | Wills | 220/3 X |

*Primary Examiner*—Steven M. Pollard
*Attorney, Agent, or Firm*—Millen & White

[57] ABSTRACT

The present invention provides a transport container for very pure liquid chemicals having an inner container or flask made of synthetic resin with an upper sealing flange, the inner container being in an outer container, which has a protective collar, provided with openings, surrounding the sealing flange at a distance. The inner container 1 is made of two skins, the inner skin being made of an inert fluoro-synthetic resin and the outer sheet 10 being made of glass-fiber-reinforced synthetic resin completely enclosing the inner skin. The outer skin 10 is in one piece with a cylindrical mantle 11, the upper section of which forms the protective collar 14.

5 Claims, 1 Drawing Sheet

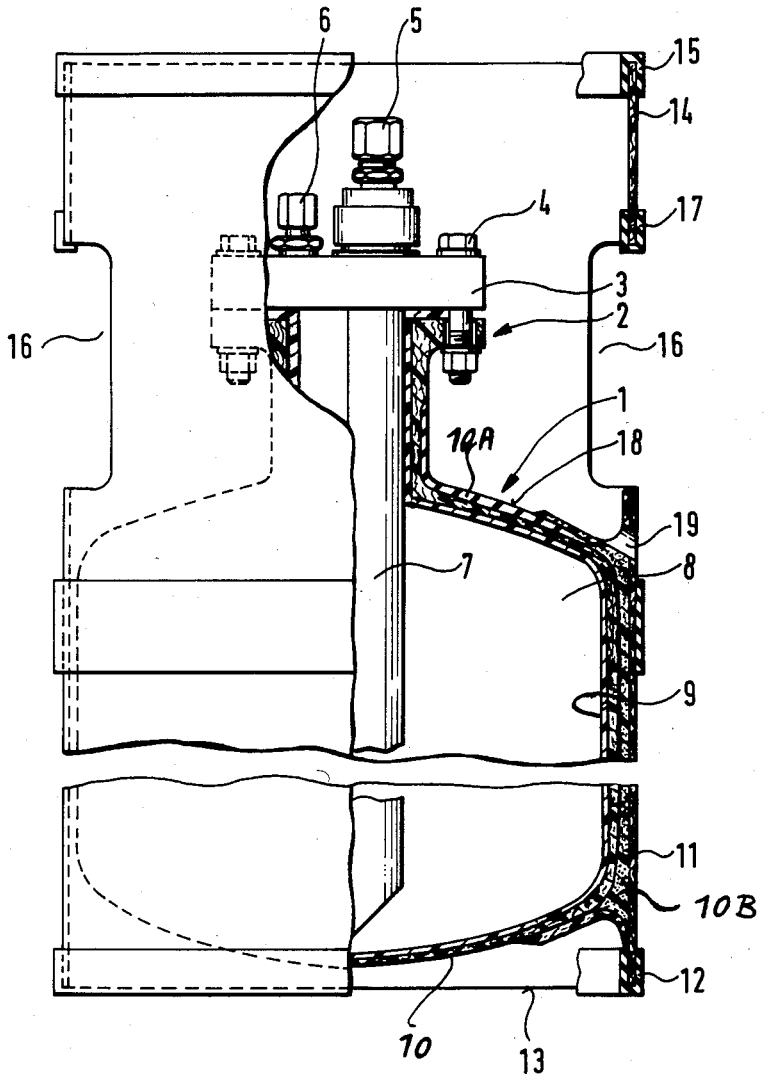
6
5
15
14
4
17
3
2
16
16
1
10A
18
19
7
8
9
11
10B
12
10
13

TRANSPORT CONTAINER

BACKGROUND OF THE INVENTION

The present invention is concerned with a transport container for very pure chemicals having an inner container consisting of synthetic resin with an upper sealing flange, the inner container being in an outer container, which has a protective collar, provided with openings, surrounding the sealing flange in spaced relation thereto.

In the production of electronic components, such as, for example, integrated circuits and high density memories, liquid chemicals are needed, the purity of which must be as high as possible. During transport, storage and handling, contamination of these chemicals must be avoided. Since, in many cases, these chemicals are toxic or harmful in other ways, an inadvertent overflow, for example due to damaging of the transport container, must, therefore, be precluded with great certainty.

The choice of material for such transport containers must, in the first place, satisfy the requirement of excluding all contamination. This requirement is admittedly fulfilled by glass containers, the danger of breakage of which, however, excludes their use as transport containers. In order to keep the stressing of the transport containers as small as possible, containers of the initially mentioned kind have hitherto been exclusively made as pressureless containers, i.e., the containers must not have any substantial internal pressure. Therefore, the removal of the liquid chemicals must also take place without the use of pressure, namely by suction pumps. However, suction pumps have moving parts which rub against one another so that contamination due to wear in the pump cannot be completely avoided.

On the other hand, especially in the case of glass containers, it is known to carry out a removal of the contents by means of an immersion tube by introducing an inert pressurized gas so that a pump is not needed and thus all wear is avoided. However, the high pressure thereby used in this process excludes the procedure in the case of pressureless containers.

SUMMARY OF THE INVENTION

Therefore, it is an object of the present invention to provide a transport container of the initially mentioned kind which meets the very high purity requirements in the case of transport, storage and removal of very pure liquid chemicals, which container has a sufficient mechanical strength to make possible its use as transport container and which makes possible a removal of the contents by means of immersion tubes without the use of pumps.

Upon further study of the specification and appended claims, further objects and advantages of this invention will become apparent to those skilled in the art.

Thus, according to the present invention, there is provided a transport container for very pure liquid chemicals having an inner container consisting of synthetic resin with an upper sealing flange, the inner container being in an outer container, which has a protective collar, provided with openings, surrounding the sealing flange at a distance, wherein the inner container is made of two skins, the inner skin being made of an inert fluoro-synthetic resin and the outer skin being made of glass-fiber-reinforced synthetic resin completely enclosing the inner skin, the outer skin being made in one piece with a cylindrical mantle, the upper section of which forms the protective collar.

The transport container constructed in this manner comes into contact with the very pure liquid container contents only on the inner skin of inert fluoro-synthetic resin so that a contamination is prevented. The enclosing outer skin of glass-fiber-reinforced synthetic resin, lying closely against the inner skin, gives the container such a high strength that it can be used as a pressure container. Emptying via an immersion tube by means of the introduction of inert gas, preferably nitrogen, is thereby possible so that a pump is not necessary. A possible wear of parts due to the parts rubbing against one another is thereby prevented.

Since the outer skin of glass-fiber-reinforced synthetic resin provides the strength for the pressure container and, at the same time, is made in one piece with the cylindrical mantle, the upper section of which forms the protective collar, in the case of a small total weight of the transport container, a uniform construction of high mechanical strength is provided which can withstand impacts possibly arising during transport and other stresses, without the danger of damage.

In further development of the concept of the present invention, the upper side of the container slopes down from the sealing flange on all sides to several outflow openings on the lower edge of the protective collar. This construction of the region surrounding the sealing flange is especially adapted to the working conditions in clean rooms. In clean rooms, a uniform, downward laminar air flow from above is usually provided. This laminar flow can flow over the sealing flange, with the filling and emptying connections and possibly pipes positioned therein, and flow substantially free of eddy currents and reaches, without disturbances, into the deepest positioned flow-off openings. The achievement of a turbulence-free flow of a descending pure air stream is, in further development of the concept of the present invention, also assisted by the provision of at least two openings in the protective collar, made as grip openings, which lie in the lower region of the protective collar. By far the greatest part of the pure air stream can thereby flow off outwardly from the region surrounding the sealing flange within the protective collar through the grip openings, whereas only a small part of the air flow emerges through the substantially smaller flow-off openings.

The contours of the inner container are made optimally not only for the described pure air flow but also for a cleaning procedure because, due to the one-piece construction of the inner container with the cylindrical, outwardly smooth-walled mantle, dead spaces and disturbing edges are avoided. The smooth outer wall of the transport container also simplifies cleaning. A pool formation of air in the region of the sealing flange or in the bottom region is also avoided.

The present invention will now be explained in more detail in the following, with reference to an embodiment thereof which is illustrated in the accompanying drawing.

BRIEF DESCRIPTION OF THE DRAWINGS

Various other objects, features and attendant advantages of the present invention will be more fully appreciated as the same becomes better understood when considered in conjunction with the accompanying drawing, in which like reference characters designate the same or simlar parts throughout the several views, and wherein:

The drawing shows, partly in side view and partly in vertical section, a transport container for very pure liquid chemicals such as are needed in the electronics industry, for example, for the production of integrated circuitry and memories of very high memory density.

DETAILED DESCRIPTION

The transport container has an inner container or flask 1 which, on its upper side, carries a central sealing flange 2. On the sealing flange 2 is placed a sealing cover 3 which is fixed by means of screws 4, the flange 2 having connections 5 and 6 for filling and emptying. One connection 5 is connected with an immersion tube 7 which extends to the deepest part of the container inner chamber 8 and serves for the removal of liquid chemicals from the container. For this purpose, a pressurized gas, for example nitrogen, is introduced through the connection 6.

The inner container or flask 1 is essentially a flask made of two skins. The inner skin or cladding 9 consists of an inert fluoro-synthetic resin, preferably of a polyfluoroalkoxy copolymer (PFA) or of polyvinylidene fluoride (PVDF).

The immersion tube 7 and all other pipe parts which come into contact with the liquid chemicals are made of the same material as the inner skin 9.

The inner skin 9 is enveloped completely by an abutting outer skin 10 of glass-fiber-reinforced synthetic resin which gives the container the necessary compressive strength so that it can be used as a pressurized container. The outer skin 10 is integral via a filling of chaff-filled rasin 10B with a cylindrical mantle 11, the lower edge of which is provided with an edge protection 12 of rubber forming a standing edge 13 for the transport container. The cylindrical mantle 11, which consists of a glass-fiber-reinforced synthetic resin, continues upwardly into a protective collar 14 which surrounds the sealing flange 2 on all sides at a distance and provides protection against mechanical damage. The upper edge of the protective collar 14 is also provided with an edge protection 15 of rubber.

In the lower region of the protective collar 14, there are provided four openings 16, lying opposite one another, as grip openings which, on their upper edge, are also provided with an edge protection 17 of rubber. The openings 16 extend to just over the upper wall 18 of the inner container or flask 1. This upper wall 18, which is protected by a rubber coating 10A slopes outwardly on all sides from the sealing flange 2. Several flow-off openings 19 lie, in each case, at the deepest point on the connection between the upper wall 18 and the cylindrical mantle 11.

When the transport container stands in a clean room under a pure air screen flowing downwardly from above, the pure air flowing down from above into the protective collar 14 flows around the sealing flange 2 and passes down and out through the openings 16 and the flow-off openings 19.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A transport container for very pure liquid chemicals having an inner container consisting of synthetic resin with an upper sealing flange, the inner container being in an outer container, which has a protective collar, provided with openings, surrounding the sealing flange at a distance, wherein the inner container is made of two skins, the inner skin being made of an inert fluoro-synthetic resin and the outer skin being made of glass-fiber-reinforced synthetic resin completely enclosing the inner skin, the outer skin being made in one piece with a cylindrical mantle, the upper section of which forms the protective collar.

2. The transport container according to claim 1, wherein the upper side of the container slopes down on all sides from the sealing flange to several flow-off openings on the lower edge of the protective collar.

3. The transport container according to claim 1, wherein at least two openings of the protective collar, made as grip openings, lie in the lower region of the protective collar.

4. A transport container for pure liquids, the container comprising:

a flask having a liner for contact with the liquid, the liner being made of an inert fluoro-synthetic resin and being laminated with a glass-fiber-reinforced synthetic resin to provide mechanical strength, the flask having an opening therein surrounded by a flange;

a cover bolted to the flange, the cover having first and second connections therethrough, the first connection communicating with the interior of the flask with an immersion tube extending therefrom to the bottom of the flask and the second connection communicating with the interior of the flask above the level of liquid in the flask so that gas pressure introduced through the second connection forces the liquid through the immersion tube and out of the flask, and a cylindrical mantle, integral with the flask and having a first portion extending above the flask and the connections thereto and a second portion extending below the flask, the first portion forming a collar having an open top, the collar having openings therethrough whereby clean-room air impinging on the container from above flows over the top of the container.

5. The container of claim 5 wherein the flask has a convex top surface when viewed from the first portion of the mantle and wherein there are openings through the first portion of the mantle where the mantle joins the flask.

* * * * *